United States Patent [19]

Fritts

[11] 3,977,111

[45] Aug. 31, 1976

[54] SIGN STRUCTURE

[75] Inventor: Robert W. Fritts, Afton, Minn.

[73] Assignee: Minnesota Mining and Manufacturing Company, St. Paul, Minn.

[22] Filed: Aug. 21, 1975

[21] Appl. No.: 606,355

[52] U.S. Cl. ..... 40/132 R
[51] Int. Cl.[2] ..... G09F 13/00
[58] Field of Search ..... 40/128, 138, 125, 125 H, 40/218, 132; 52/302, 2

[56] References Cited

UNITED STATES PATENTS

| | | | |
|---|---|---|---|
| 1,426,475 | 8/1922 | Hawthorne | 40/138 |
| 1,555,102 | 9/1925 | Chatfield | 40/138 |
| 1,647,899 | 11/1927 | Bowers | 40/152.2 |
| 1,777,933 | 10/1930 | O'Brien | 40/218 |
| 3,372,303 | 3/1968 | Weeks | 40/129 C |
| 3,521,390 | 7/1970 | Carlson | 40/138 |

*Primary Examiner*—Louis G. Mancene
*Assistant Examiner*—Wenceslao J. Contreras

[57] ABSTRACT

An internally illuminated sign structure comprising a housing enclosing a plurality of lamps and having an open front in which is supported a windbalanced sheet of translucent film bearing the sign messsage. The housing has passages communicating with the laminar air flow region about the housing to the interior to allow air to enter the structure, which air would develop a pressure equal to that developed by the wind component striking the face of the film to afford a static balance on the front face of the film. The passage to the interior of the housing has a total cross-sectional area at the plane of the film of at least 5 times the combined area of any other openings in the housing which do not receive the force of the winds against the front face. Other openings in the housing may be drain holes for moisture, air leaks around access openings etc.

12 Claims, 4 Drawing Figures

SIGN STRUCTURE

BACKGROUND OF THE INVENTION

1. Field of the Invention

This invention relates to an improvement in sign structures wherein the sign face is formed on a sheet of film and in one aspect to a sign housing that is designed to balance the pressure on the rear surface of the sign face with the wind pressure on the exposed front face of the film to maintain a static balance of the film.

2. Description of the Prior Art

Signs having a housing with an open front face in which is positioned a sign face which may be permanent or changeable are well known. The sign face in most of these structures is rigid plastic material or glass and is backlighted for illuminating the sign. It is also known in the prior art to suspend sheet material from its corners to provide a large sign board or to place a film over the front of the housing.

The disadvantages of the rigid plastics (such as acrylics, polycarbonates, cellulose acetate butyrate materials, fiberglass, etc.) for illuminated signs is that the use of such materials is cumbersome and expensive for large outdoor advertising purposes. It is difficult and costly to change the heavy sign faces. The weight requires heavy structural members in the frame and extensive lifting mechanisms. Additionally, the rigid sheets are subject to breakage from sudden wind gusting and from vandalism.

The suspended flexible sheet material is subject to bowing when receiving a wind force and when a high wind loading occurs the material will tear or become twisted.

A flexible plastic sheet adhered over an opening in a housing will bow and may strike the lamps or other structure within the sign or it will receive such a force that the plastic film will suffer permanent distortion because of the high wind loading against the face of the sign.

Summary of the Present Invention

The present invention provides a sign structure having a housing that can be internally illuminated by an array of fluorescent or mercury arc lamps. Across the face of the housing is a flexible translucent sheet on which the message or copy is painted. The sheet is supported in tension in the housing in an opening in the front face of the housing. The sheet displays a continuous copy uninterrupted by gaps. It is highly resistant to vandalism, and because of its light weight and flexibility it can be easily changed in the field. The housing is provided with means affording a balance of pressure on each side of the sheet to avoid the sheet being bowed when a frontal wind strikes the sign face. The balancing of the forces on the sign face is accomplished by passageways communicating with the front of the sign structure such that a force equal to the frontal component of the wind force will be created within the housing against the rear of the sheet to stabilize the sheet in its plane in the opening in the housing.

The sheet is preferably supported in the housing at its edges and with thin flexible sheets and films it is stretched sufficiently to remove any folds or wrinkles. The fastening means for the film may include springs connected to grommets along the edges of the film and to the side walls of the housing, or opposite edges of the film may be connected to a support rod or member which is drawn toward the edges of the housing at spaced joints by bolts, turnbuckles, clamps or the like.

The passageways can include slotted openings extending around the sheet at the front of the housing or other ducts communicating with the housing behind the sheet and positioned along an edge of the sign and opening forwardly in the direction of the front face.

This invention provides for the balancing of the air pressures on a sign face by applying pressures created by the wind within the sign housing behind the sign face.

BRIEF DESCRIPTION OF THE DRAWING

The invention will be more fully described in reference to the accompanying drawing wherein.

DETAILED DESCRIPTION OF THE PREFERRED EMBODIMENT

Figure 1:
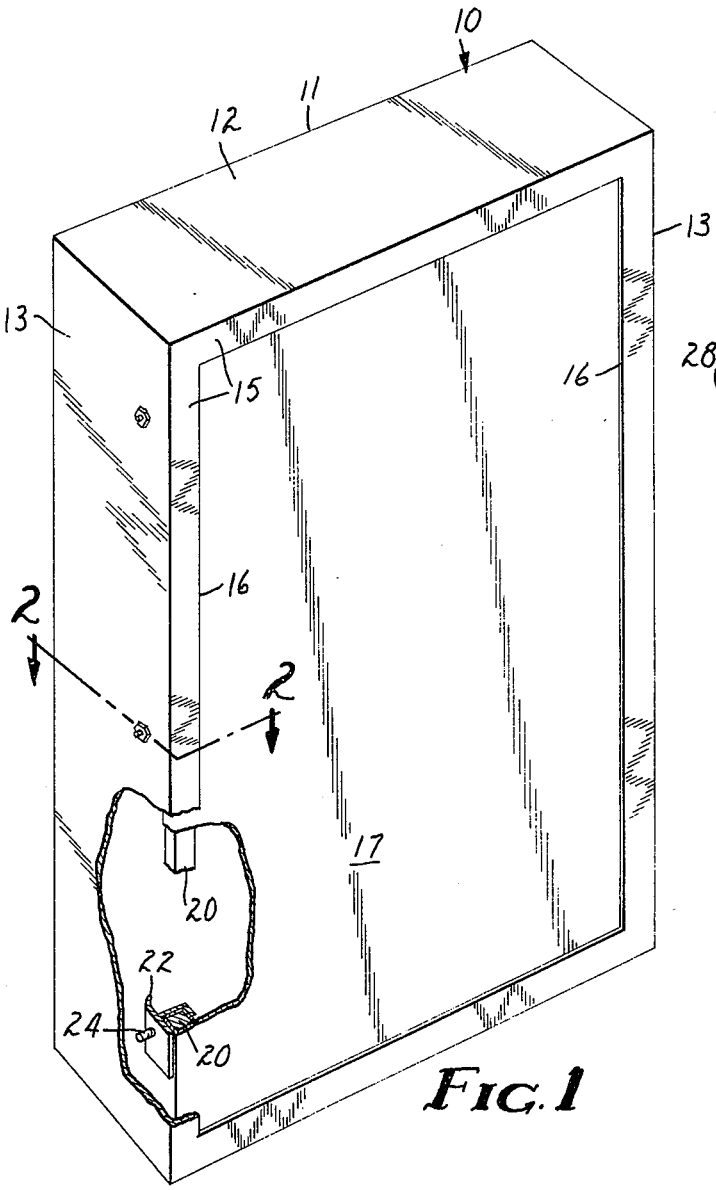
FIG. 1 is a perspective view of a sign structure constructed according to the present invention with portions thereof broken away to show interior members.

The present invention provides a sign structure which may be illuminated or not for outdoor advertising, such as signs of 3 meters by 12 meters to 4.25 meters by 14.6 meters, which may be easily changed and which is resistant to vandalism and which will maintain its neat appearance for the desired period of time irrespective of the interim wind conditions. The sign face is uninterrupted by gaps. The sign structure of the present invention comprises a housing indicated generally be reference numeral 10 which is adapted to be supported by suitable posts and braces in the desired location. The housing 10 has a back or rear wall 11 and edge walls including top and bottom walls 12 and side walls 13. The front face of the housing 10 is generally open and the sign face is supported in a plane in the front opening. A coaming or frame may be supported at the front of the housing 10 forward of the sign face and this frame is formed by extended portions of the edge walls and flanges 15 extending from the front edges of the extended top and bottom walls 12 and side walls 13 and terminating to form a front rectangular opening 16.

The sign face is formed by a sheet of flexible fabric or film 17 such as polyvinyl chloride on which the message or sign copy is painted. Means are provided for supporting the film 17 in a plane parallel to the plane of the opening and in such a manner that the film may be stretched to remove folds or wrinkles therein.

Positioned behind the film 17 and within the housing 11 are an array of fluorescent lamps 18 which afford a backlighting for the entire face of the sign for excellent nightime illumination.

Figure 2:
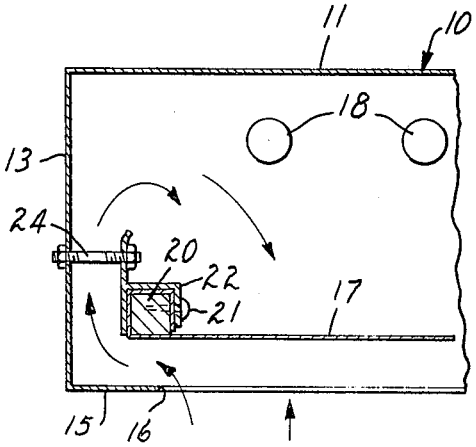
FIG. 2 is a detailed sectional view of the sign structure of FIG. 1 taken along line 2—2.

In FIG. 2 there is shown a detail of the means for supporting the film 17. The film 17 has its opposite edges wrapped about and secured to a support member 20. The film 17 and the support member 20 are then secured by a fastener 21 (e.g. a screw or lag screw) into a plurality of spaced frame clamps 22. The clamps 22 are adapted to be supported from the edge walls of the housing by means of adjustable fastening members 24 such as threaded nuts and bolts to suspend the film and frame members 20 within the housing. The adjustable fasteners 24 aid in stretching the film and positioning the same in a plane in the front of the housing. Other suitable means for securing the film include tension springs which may be secured to the side walls 13 and which may be affixed at the opposite end in grommets positioned along the edge of the film. The springs would have sufficient strength to stretch the film to draw it tight and sufficient length to accommodate displacement of the film caused by sudden wind gusts or thrown objects.

The fastening means are so positioned in the sign structure indicated in FIGS. 1 and 2 to define between the front face of the film 17 and the flanges 15 a passageway leading to the edge wall 13, and the edges of the film are spaced sufficiently from the edge walls 12 and 13 to define a passageway therebetween, and the edge walls project past the plane of the film such that air is stopped from flowing off the edge of the front face of the film to transmit pressure into the housing. This passageway defined by the spaced relationship of the sign copy, the flanges and the edge walls 12 and 13 allow air at a pressure of a component of the wind striking the front face of the sign to enter the housing, developing thereby a counter-balancing pressure in the housing against the back of the film substantially equal to the "ram" pressure created on the front face of the film to avoid bowing of the film or permanent distortion of the film. This wind balanced condition (static balance) is only on the sign face or the film and not the sign structure as a whole.

Figure 3:
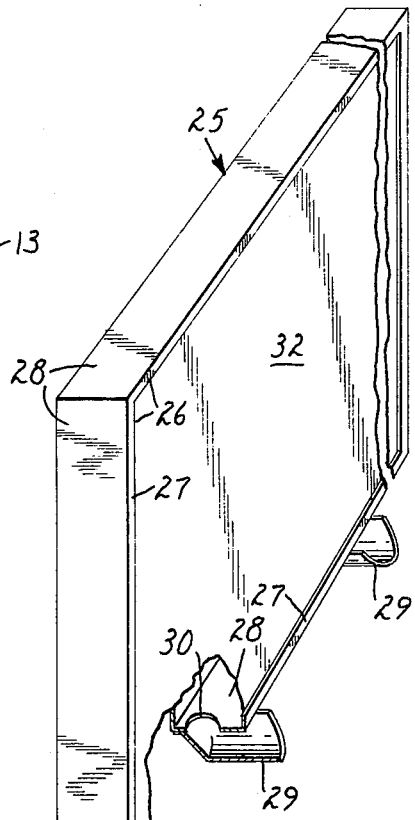
FIG. 3 is a perspective view of a sign structure according to the present invention showing a second embodiment, with portions broken away to show interior members.

The sign structure shown in FIG. 3 comprises a housing generally designated 25 having a front opening 26 defined by a flange 27 extending inward from the edges of the side walls 28. The means defining the passageways from the front face of the sign into the housing in this structure comprise a pair of ducts 29 communicating with the interior of the housing 25 by openings 30. Obviously, one or a plurality of ducts 29 can be used. The ducts 29 are attached to the bottom edge wall 28 and positioned with forward facing openings at the front face of the sign structure to capture the frontal component of any wind against the front of the sign structure and directing the pressure of the wind into the housing 25 to develop the counterbalancing force within the housing to offset the force against the front face of a film 32 forming the sign face and supported at the opening 26.

In a typical sign structure according to the structure shown in FIG. 3 the sign may be 4.25 meters high and 14.6 meters wide with a duct 29 disposed every 3.6 meters along the bottom wall thereof with each duct 29 having a cross-sectional area of 0.25 sq. meters.

The polymeric film used for the sign structure of FIG. 1 or FIG. 3 is a translucent material to reduce the exposure of the lamps and diffuse the light. The film is preferably 10 to 25 mils thick and comprises preferably a polyethylene terephthalate mesh to give the film strength with a polyvinyl chloride film laminated on both sides of the polyethylene terephthalate mesh. A white pigment in the film provides for 40% light transmission providing for good night-time visibility and also adequate day-time visibility from ambient light. The film is imaged with opaque or translucent paint on the front surface of the film.

A wind blowing against an exposed surface of a sign develops a strong force against that surface. The force of the wind against the surface increases as the square of the wind velocity, for example:

| Wind Speed Kilometers per Hr. | "Ram" Pressure from Stopped Wind Kilograms Per Sq. Meter |
|---|---|
| 16 | 1.27 |
| 48.3 | 11.2 |
| 80.45 | 31.3 |
| 112.6 | 61 |

With a frontal wind of 112.6 kilometers per hour (often achieved in thunderstorms throughout the United States of America) a plastic film 3.048 meters high and 12.19 meters wide will sustain a wind load of 2.3 metric tons (2268 kilograms) at right angles to the face. Without wind balancing such a load will displace most flexible materials into damaging contact with the internal structure of the sign. The wind balancing afforded by the structures of the present invention provides a housing such that the frontal wind is captured to transmit "ram" pressure of the wind into the interior of the housing. This pressure in the interior of the housing will counterbalance the ram pressure created on the front surface of the film exposed to the wind.

The housing may have a number of openings in the rear wall or sides which can cause air leakage from the interior of the housing (for example, rain water drain holes, loose fitting access panels, ventilation holes etc.). It is therefore necessary to obtain a windbalanced condition that the passageway around the edges of the film or the ducts leading into the housing for trapping the frontal component of the wind have a total area of at least 5 times the total area of all other wind leaks.

Figure 4:
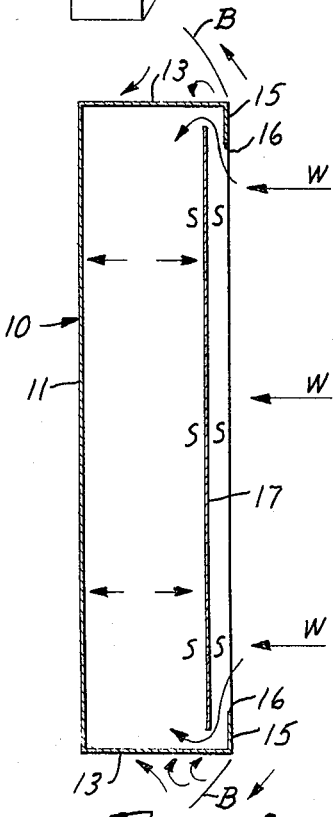
FIG. 4 is a diagrammatic view of the sign structure illustrating the operation of a structure according to FIG. 1.

Referring to FIG. 4 there is shown schematically a sign structure corresponding to the present invention. A wind as indicated by the arrows W directed against the front face or the frontal components of a wind produce on the front face a static pressure next to the surface of the film and following wind flows off the edges. The air flowing off the edge of the front face is captured by the flanges and directed around the film transmitting pressure onto the housing. To achieve the windbalanced condition the flanges must protrude through the boundary layer B between the region of turbulent air flow and region of streamline or laminar air flow into the region of streamline or laminar air flow about the housing when a wind is striking the front of the sign structure or the sign face. Alternatively, ducts such as the ducts 29 may trap the air at or along the edge of the sign face but the inlet must be slightly forward of the boundary layer or the face to transmit air having greater than atmospheric pressure and equal to that applying pressure against the sign face into the housing to provide the adequate balancing.

The important concept is that the wind exerts a force only on a surface that impedes wind (the flow of air mass). It is the component of the wind normal to the sign face that is of importance. The additional pressure (over normal atmospheric pressure) that is applied to a surface that "stops" wind is $$\Delta P = \tfrac{1}{2}\,(\text{air density}) \times (\text{velocity})^2$$

where velocity is that of the wind upstream of the blocking surface. This is the important concept because the housing that provides windbalancing must have some duct or flange configuration that projects out into the laminar or non-turbulent frontal air stream to stop a portion of the air flow to develop this balancing pressure and transmit this pressure into the interior of the housing. Simple openings at the edge of the film face over which the wind flows which are just in a plane parallel to the plane of the film will not block the laminar flow adequately and thus will not develop enough balancing pressure. The flow must be stopped in the mouth of the duct extending beyond the film plane toward the air flow or trapped by the projected side walls or projected side walls and flanges 15.

FIG. 4 shows a housing with the sign face stretched in the mouth or opening of the housing with an opening between the edges of the face and the housing, allowing air movement around the edge of the film into and out of the housing. This structure has the edge walls protruding forward beyond the plane of the film, and has flanges projecting therefrom in the plane of the film, the flanges catch the wind sweeping around the edge of the sign face, partially stopping the wind, thus building the ram pressure toward the value of the ram pressure on the front face. If the edge walls 13 are fitted with a turned flange as shown in FIG. 2 by numeral 15 it stops the wind even more effectively and brings the face into a well-balanced condition. The flange 15 also serves to block internal light from being visible from the front of the sign.

Actual wind conditions include gusting components that may be as high as 25% of the average wind velocity. Full wind balancing against the gusting component (increasing/decreasing velocity) is not required nor totally achievable. As wind velocity changes the ram pressure also changes and air must flow in and out of the housing through the balancing openings in response to pressure changes. This gives rise to a minor undulation or ripple of the front face without a large net displacement of the overall front face. There are some optimum relationships between duct area, duct length, and housing volume that allow good damping of the gust-induced vibration. However, these relationships are not well developed as this gust reaction has not been that significant a problem in the field, thus the preferred form is to provide sufficient openings to handle the steady wind components. Winds from the rear of the sign subject the sign face to turbulent air and thus the passageways operate in a similar manner to balance the pressures against the opposite surfaces of the sign face.

It is desirable that the passageways for the frontal air into the housing in the plane of the film have a total area of at least 5 times the total area of all other openings or air leaks out of the housing through the rear wall or edge walls. The actual ratio should depend on actual design parameters such as size of housing, front area and depth of housing, strength of film, the flexibility of the film, and wind velocity. A preferred range in area from 10 to 20 times greater than the area of other openings is preferred in large signs with a film of 4.25 meters by 14.6 meters and provides good pressure interiorly to have a static condition for the film or sign face achieving a counterbalancing of the static pressures S on both sides of the film. The sign face may be other sheet materials than the film described herein such as canvas, "sail" goods, cast acrylic sheets or other materials on which sign faces may be imparted.

Having thus described the invention with reference to the illustrated preferred embodiments it is to be understood that structural modifications may be made therein without departing from the invention as defined in the appended claims.

I claim:

1. A sign structure comprising means defining a generally closed housing for supporting a sign face and having a forward opening, a sheet, means supporting said sheet in a plane at the forward opening, and means defining a passageway from a region of laminar air flow into the housing to the rear of the sheet, said passageway having a total cross-sectional area greater than the combined area of any other openings in said housing for catching air at a pressure of the wind component against the front face and developing a pressure in the housing substantially equal to the pressure on the front surface of the sheet to develop a wind-induced counterpressure on the interior surface of the sheet to balance the net wind force acting on the front face of the sheet.

2. A sign structure according to claim 1 wherein lamps are disposed in the housing to the rear of the sheet plane.

3. A sign structure according to claim 1 wherein the sheet is translucent.

4. A sign structure according to claim 2 wherein the sheet is translucent.

5. A sign structure according to claim 1 wherein said means defining a passageway comprises edge walls on the housing which project forward of the plane of the sheet into the region of laminar flow and which are spaced from the corresponding edges of the sheet.

6. A sign structure according to claim 5 wherein flanges are formed on said edge walls and project therefrom toward each other in a plane generally parallel to the plane of the sheet.

7. A sign structure according to claim 1 wherein said means defining a passageway comprises at least one duct having an opening in a plane parallel to the plane of the sheet and positioned forwardly of the plane of said sheet and leading into said housing.

8. A sign structure according to claim 1 wherein said total cross-sectional area of said passageway is at least 5 times greater than the combined area of any other openings in the housing.

9. A sign structure according to claim 6 wherein said total cross-sectional area of said passageway is between 5 to 20 times greater than the area of any other openings in the housing.

10. A sign structure according to claim 7 wherein said total cross-sectional area of said passageway is between 5 to 20 times greater than the area of any other openings in the housing.

11. A sign structure for outdoor advertising and comprising:

a housing having a rear wall and top, bottom and side edge walls, an array of lamps in said housing, a flexible translucent film, means supporting said film in a plane between said edge walls, and means projecting forwardly of said film plane for stopping air at a pressure of the wind component perpendicular to the front face of the film for developing a pressure in the housing substantially equal to the pressure on the front surface of the film to develop a wind-induced counterpressure on the interior surface of the film to balance the net wind force acting on the front face of the film.

12. A sign structure according to claim 11 wherein said means for stopping air comprises a passageway around the film, the cross-sectional area of the passageway in the plane of the film being greater than 5 times the total area of any openings in the rear wall or edge walls.

* * * * *